US006538572B2

(12) United States Patent
Lian et al.

(10) Patent No.: US 6,538,572 B2
(45) Date of Patent: Mar. 25, 2003

(54) PRINTED BIAS MAGNET FOR ELECTRONIC ARTICLE SURVEILLANCE MARKER

(75) Inventors: Ming-Ren Lian, Boca Raton, FL (US); Richard L. Copeland, Boynton Beach, FL (US); Kevin Romer, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/918,619

(22) Filed: Jul. 30, 2001

(65) Prior Publication Data

US 2003/0020612 A1 Jan. 30, 2003

(51) Int. Cl.[7] ..... G08B 13/14

(52) U.S. Cl. ..... 340/572.1; 148/100; 340/572.2; 340/572.8; 428/611

(58) Field of Search ..... 340/572.1, 572.2, 340/572.3, 572.6, 572.8; 148/100, 120, 121; 428/611, 900, 901

(56) References Cited

U.S. PATENT DOCUMENTS

| | | | | | |
|---|---|---|---|---|---|
| 4,510,489 | A | | 4/1985 | Anderson et al. | 340/572 |
| 5,341,125 | A | | 8/1994 | Plonsky et al. | 340/572 |
| 5,401,584 | A | * | 3/1995 | Minasy et al. | 428/611 |
| 5,426,419 | A | | 6/1995 | Nguyen et al. | 340/572 |
| 5,469,140 | A | | 11/1995 | Liu et al. | 340/551 |
| 5,499,015 | A | | 3/1996 | Winkler et al. | 340/551 |
| 5,568,125 | A | | 10/1996 | Liu | 340/551 |
| 5,712,045 | A | * | 1/1998 | Miyai | 428/522 |
| 5,859,587 | A | | 1/1999 | Alicot et al. | 340/572 |
| 6,067,015 | A | | 5/2000 | Lian et al. | 340/572.1 |
| 6,099,973 | A | * | 8/2000 | Miyai et al. | 428/532 |
| 6,121,879 | A | | 9/2000 | Lian et al. | 340/572.3 |
| 6,419,498 | B1 | * | 7/2002 | Ikeda et al. | 434/409 |

* cited by examiner

*Primary Examiner*—Thomas Mullen
(74) *Attorney, Agent, or Firm*—Rick F. Comoglio

(57) ABSTRACT

The present invention replaces the conventional bias magnets for EAS markers with a paintable or printable bias magnet material, which is either directly painted onto the EAS marker or first placed onto a substrate material, which is then placed into the EAS marker. The material includes a magnetic powder mixed with resin and solvent. This "bias paint" is then applied onto the EAS marker. The magnetic powder, resin, and solvent provide a very dense layer after drying, which has a magnetic material density that is usually lower than a rolled product, but is higher than that of the injection-molded magnet material. Printing the bias magnet allows nondeactivatable magnetomechanical EAS markers to be made using web-based mass production methods.

19 Claims, 15 Drawing Sheets

| | | | |
|---|---|---|---|
| AVERAGE | 58.1594 | 3.1565 | 457.9 |
| STDEV | 0.067025 | 0.122357 | 20.62421 |
| MIN | 57.998 | 2.88 | 428 |
| MAX | 58.271 | 3.31 | 503 |

| PIECE | FREQ(kHz) | AMP(nWb) | Q |
|---|---|---|---|
| 1 | 58.116 | 3.26 | 437 |
| 2 | 58.157 | 3.2 | 503 |
| 3 | 58.208 | 3.14 | 451 |
| 4 | 58.258 | 3.02 | 428 |
| 5 | 58.116 | 3.29 | 476 |
| 6 | 58.143 | 2.94 | 432 |
| 7 | 58.139 | 3.15 | 465 |
| 8 | 58.271 | 2.88 | 442 |
| 9 | 58.14 | 3.26 | 481 |
| 10 | 58.244 | 3.1 | 451 |
| 11 | 58.146 | 3.16 | 460 |
| 12 | 58.158 | 2.99 | 431 |
| 13 | 58.044 | 3.31 | 450 |
| 14 | 58.165 | 3.14 | 477 |
| 15 | 57.998 | 3.3 | 430 |
| 16 | 58.132 | 3.16 | 481 |
| 17 | 58.215 | 3.11 | 460 |
| 18 | 58.158 | 3.27 | 472 |
| 19 | 58.232 | 3.2 | 466 |
| 20 | 58.148 | 3.25 | 465 |

FIG. 10

PRINTED BIAS MAGNET FOR ELECTRONIC ARTICLE SURVEILLANCE MARKER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to magnetomechanical electronic article surveillance (EAS) markers, and more particularly to a printed bias used in a magnetomechanical EAS marker.

2. Description of the Related Art

EAS markers are typically attached to articles of merchandise and respond to an electromagnetic field transmitted into an interrogation zone located at the exits of a controlled area. The response of the EAS markers to the electromagnetic field is detected and indicates that the article is being removed from the controlled area without authorization. An alarm can be sounded upon receiving the EAS marker response to alert relevant personnel of an attempt to remove the article.

Conventional magnetomechanical EAS markers that have a magnetostrictive resonator typically use a magnet as a control element either for biasing or deactivation or both. For deactivatable labels, the bias magnet is usually a semi-hard rolled product magnet material. For hard tags that are nondeactivatable, the bias magnet is usually an injection molded ferrite magnet material. The term "marker" refers to both "tags" and "labels".

Nondeactivatable EAS hard tags are primarily used in the tagging of soft goods, such as clothing in retail stores. The tags, such as that disclosed in U.S. Pat. No. 5,426,419, consist of a plastic housing that contains a magnetoacoustic resonator element and a clutching mechanism. The hard tag assembly process starts with two halves of the plastic housing that are formed using injection molding. The internal parts (resonator, spacer, bias magnet, and clutch/clamp assembly) are placed within the housing, and the two halves of the housing are sealed together, typically using ultrasound energy. The tag can then be attached to articles to be protected by insertion of the pin body through a portion of the article and into the clutching mechanism. The pin cannot be released to detach the tag from the merchandise unless the clutch is opened by a mechanical or magnetic detacher mechanism designed for the particular tag.

Referring to FIG. 1, a flow chart of the present manufacturing process for hard tags is illustrated. The bias magnets are produced using an extrusion or injection molding process at step 2. Magnetic particles with coercivity higher than 3000 Oe are used to make reusable or nondeactivatable markers. These particles are mixed with plastic binder/resin, and are heated to a molten state. They are then molded into individual pieces with injection molding. The extrusion process can also be used to produce a continuous roll having a strip of magnetic material with a thickness of about 30 to 50 mils. The roll can then be slit and cut into individual pieces with desired dimensions at step 6. Magnetization of the material at step 4 can be performed before or after the cutting process. A batch of resonator strips is also properly cut at step 8 to match with the strength of the magnetic bias strips. The two halves of the plastic housing are formed using injection molding at step 10. The resonator is placed into the cavity formed in the plastic housing halves at step 12. A spacer is placed at step 14 prior to placing the bias magnet at step 16. The clutch assembly is placed into the plastic housing at step 18. The two plastic housing halves are ultrasonically sealed together at step 19 to complete the tag at step 20. Due to the thickness of the magnetic bias, a thin reusable marker is not available.

Referring to FIG. 2, the manufacturing process of deactivatable labels, such as disclosed in U.S. Pat. No. 6,067,015, is similar to hard tags with some significant differences. The bias magnets are not extruded but made of a semi-hard magnetic metal. The housing is made of a vacuum thermal formed polystyrene. There is no clutch assembly used in a deactivatable label, and the spacer and cover are heat sealed to the housing. Referring to FIG. 2, steps that are identical to the steps performed in FIG. 1 are given the same reference numerals. The vacuum-formed housing is produced at 22, after the resonator is cut 8 and placed into the cavity 12, a spacer lid is placed over the resonator and the cavity at 24, and may be heat-sealed in place. The semi-hard bias magnet material is heat treated and annealed to form a roll having desired bias magnetic properties at 26, and after cutting at 6, the bias magnet is placed onto the spacer at 17, and may be adhesively attached. If the bias is not adhesively attached, a cover lidstock material is placed over the bias at 28 and heat sealed to the housing at 30. The bias magnet is magnetized at step 4 to complete the process.

Disclosed in the '015 patent are bias magnets formed in various shapes to improve the performance of the EAS label. However, all of these deactivatable bias magnets must be cut from a batch of magnetic material, which is normally formed into a roll after the material is properly heat treated and annealed to obtain desired properties. It should be apparent that shapes other than rectangular each present varying degrees of cutting and forming difficulty, which increase the cost to make EAS markers having shaped bias magnets.

There presently exists a need for an EAS tag that is thinner than those made by conventional methods, and for a bias magnet material this is easier to form into various bias shapes such as, but not limited to, those disclosed in the '015 patent.

BRIEF SUMMARY OF THE INVENTION

The present invention replaces the conventional bias magnets for EAS markers with a paintable or printable bias magnet material, which is either directly painted onto the EAS marker or first placed onto a substrate material, which is then placed into the EAS marker. The material includes a magnetic powder mixed with solvent and resin. This "bias paint" is then applied onto the EAS marker. The magnetic powder and solvent provide a very dense layer after drying, which has a magnetic material density that is usually lower than a rolled product, but is higher than that of the injection-molded magnet material.

A first aspect of the invention is a mapetomechanical electronic article surveillance marker having a housing with a cavity formed therein. A magnetostrictive resonator member is disposed within the cavity. A cover is connected to the housing over the cavity capturing the resonator member therein. A bias magnet is disposed adjacent the resonator member, where the bias magnet is a magnetic powder mixed with at least one material to form a paint that is disposed adjacent the resonator by being painted onto the housing or onto the cover. The bias magnet can be painted onto a substrate, and the substrate can be connected to the housing or to the cover wherein the bias magnet is disposed adjacent the resonator. The bias magnet can be formed of a plurality of layers.

A second aspect of the invention is a method of making a magnetomechanical electronic article surveillance marker by the steps of preparing magnetic ink by mixing magnetic particles with a resin and solvent material. Printing the magnetic ink onto a substrate and curing by heating. Providing a housing having a cavity formed therein, cutting and placing at least one resonator into the cavity. Placing the substrate over the cavity wherein the magnetic ink is aligned adjacent the resonator, and connecting the substrate to the housing, capturing the resonator within the cavity wherein the magnetic ink is disposed adjacent the resonator. The method can include printing and curing in a plurality of passes to form multiple layers of magnetic ink on the substrate. The cavity can be formed by printing nonmagnetic ink onto a flat housing material. A cover can be sealed to the housing capturing the resonator within the cavity prior to connecting the substrate to the housing.

A third aspect of the invention is similar to the second except the ink is printed directly onto the housing adjacent the cavity, instead of onto the cover.

A fourth aspect of the invention is a harmonic electronic article surveillance marker having an active element for receiving and radiating an interrogation signal generated by an electronic article surveillance system transmitter. The active element being an elongated strip of magnetic material that produces harmonic perturbations of the interrogation signal, and a plurality of control elements disposed along the active element. The control elements are for being magnetized to deactivate the electronic article surveillance marker. Each of the plurality of control elements includes a magnetic powder mixed with at least one material to form a magnetic paint. The magnetic paint is disposed along the active element by painting in at least one preselected shape.

Objectives, advantages, and applications of the present invention will be made apparent by the following detailed description of embodiments of the invention.

BRIEF DESCRIPTION OF THE SEVERAL VIEWS OF THE DRAWINGS

FIG. 10 is a table showing the performance of an EAS marker made according to the present invention.

DETAILED DESCRIPTION OF THE INVENTION

A magnetic material powder such as, but not limited to, $\gamma$-$Fe_2O_3$ (gamma iron oxide), $BaO{\cdot}6[Fe_2O_3]$ (barium ferrite), or $Nd_2Fe_{14}B$ (neodynium iron boron) is used along with a suitable resin and solvent to form a paint or ink that can be applied to a substrate material or directly to an EAS marker housing as a bias magnet. For the semi-hard magnet material for deactivatable labels, all of the rolling, heat treatment annealing processes, and bias cutting are eliminated. For the injection-molded nondeactivatable magnet material used in hard tags, all of the expensive injection molding equipment is eliminated. Complex geometry shapes can easily be obtained using the painted or printed bias magnet. Painting and printing are used synonymously herein, as are paint and ink.

Two different magnetic powder materials are used to demonstrate the invention. The first material used is $\gamma$-$Fe_2O_3$ (gamma iron oxide) powder. The intrinsic coercivity of this type of powder can be made to be as low as about 200 Oersted, which is nearly an order of magnitude higher than the lowest coercivity achievable with conventional semi-hard magnetic materials. Due to the lower loading density, the magnetic flux of the particulate magnet is approximately an order of magnitude less than conventional semi-hard magnetic materials. Nonetheless, in certain applications these differences are not prohibitive when considering the potential cost improvements and ease of manufacturing benefits that come with the particulate bias magnet.

Figure 3:
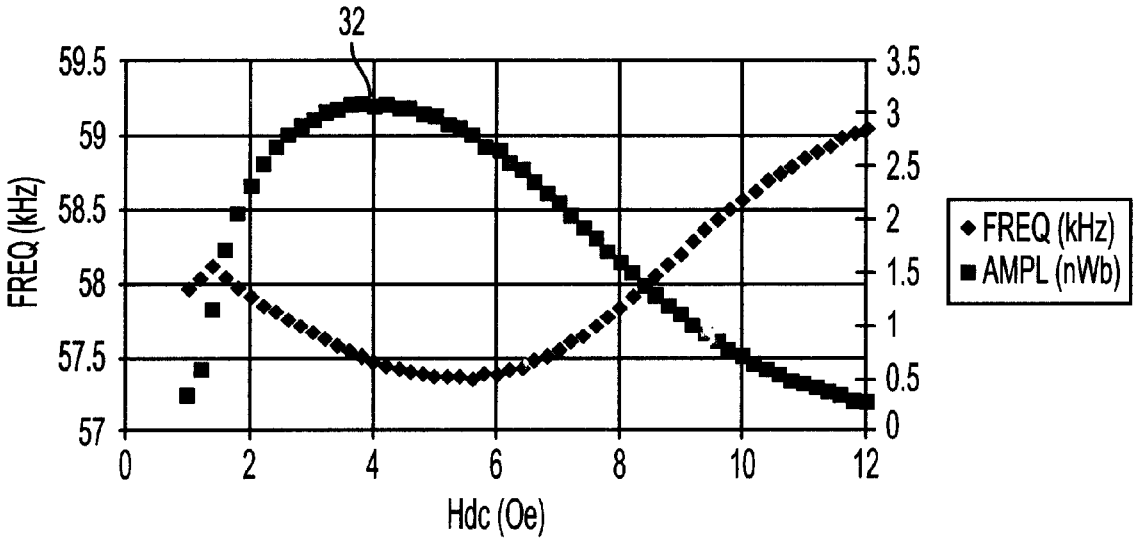
FIG. 3 is a plot of the resonant properties of a low-bias amorphous resonator.
Figure 4:
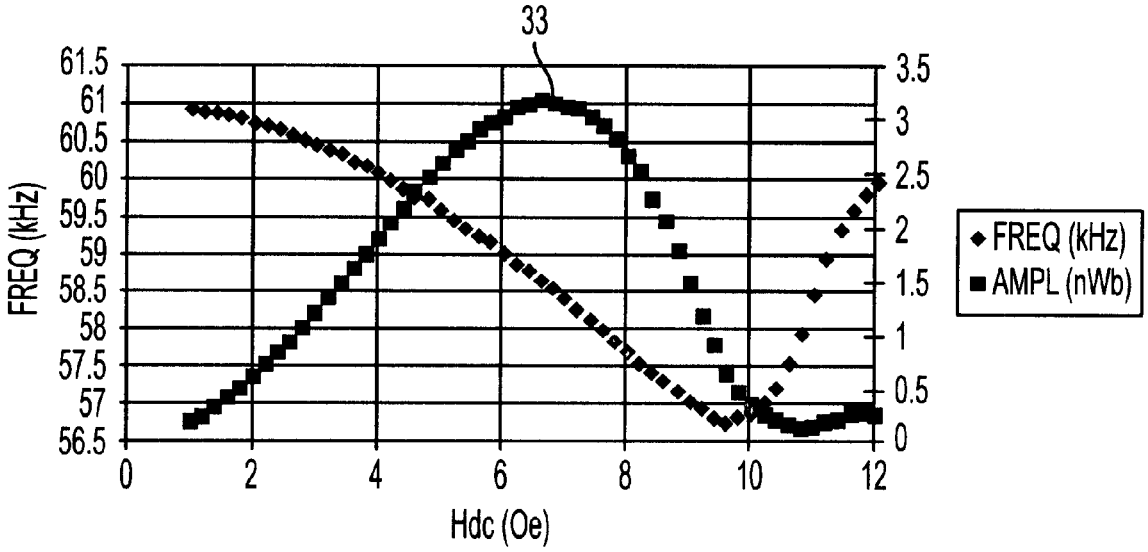
FIG. 4 is a plot of the resonant properties of a regular-bias amorphous resonator.
Figure 5:
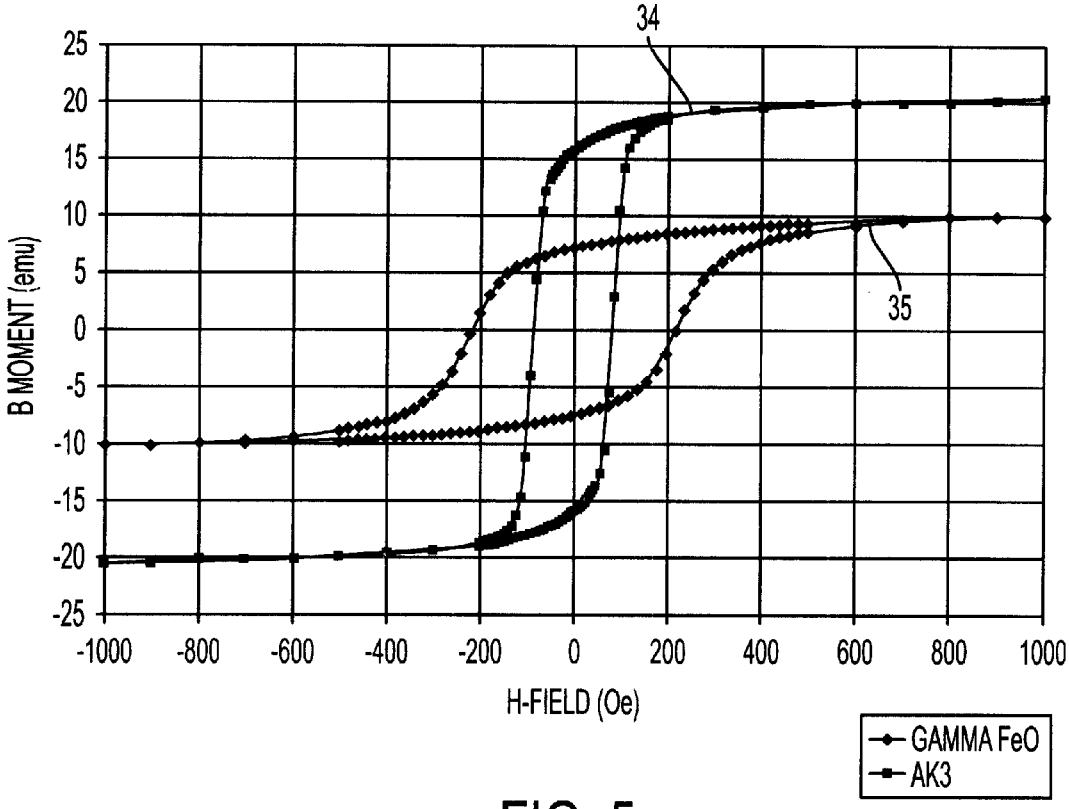
FIG. 5 is a comparison plot of the hysteresis response of a conventional and printed bias.

Referring to FIGS. 3 and 4, the properties of the amorphous resonator can be designed such that its optimal bias point is reduced from its normal level. FIG. 3 shows the resonant properties of a low-bias amorphous resonator, as opposed to a regular amorphous resonator, as shown in FIG. 4. A magnetic field of about 4 Oersted (Oe) is required for the low-bias resonator shown in FIG. 3, to operate at its peak amplitude 32, as compared to about 6 to 7 Oe required for the regular resonator shown in FIG. 4 to operate at its peak amplitude 33. This implies that the bias layer can be made thin, which is much easier to achieve in the painting process compared with the prior processes. With a lower bias field requirement, the label with painted bias will experience less magnetic clamping as well as provide higher label amplitude. Furthermore, with the low-bias resonator, the markers will experience a shift of resonant frequency of about 160 Hz while being exposed to the maximum earth's magnetic field. This level compares favorably to a 600 Hz frequency shift in a conventional resonator. Referring to FIG. 5, a comparison of the hysteresis loop 34 for a conventional semi-hard magnet, Arnokrome-3, (AK3) available commercially from Arnold Engineering, and the hysteresis loop 35 for a $\gamma$-$Fe_2O_3$, bias paint magnet with the same overall shape and area is illustrated. The magnetic remanence, B value where H=0, is about twice as high for AK3 as for the gamma iron oxide material. The samples used herein have a thickness of about 2 mils for the AK3 and about 10 mils for the gamma iron oxide. A gamma iron oxide layer of about 20 mils would be required for equivalent bias to the AK3. Using the low bias resonator reduces this thickness requirement. The H value corresponding to the saturation value of B is approximately 200 Oe for AK3 and about 400 Oe for gamma iron oxide material. Therefore, the gamma iron oxide material is harder to magnetize or demagnetize in comparison to Ak3 by approximately the same ratio.

There are applications where deactivation of the EAS marker is not necessary. In these applications, magnetic powder materials, such as $Nd_2Fe_{14}B$, with a higher coercivity and a higher magnetic remanence, are more suitable to hard tags, which need a high degree of protection from demagnetization.

Figure 6:
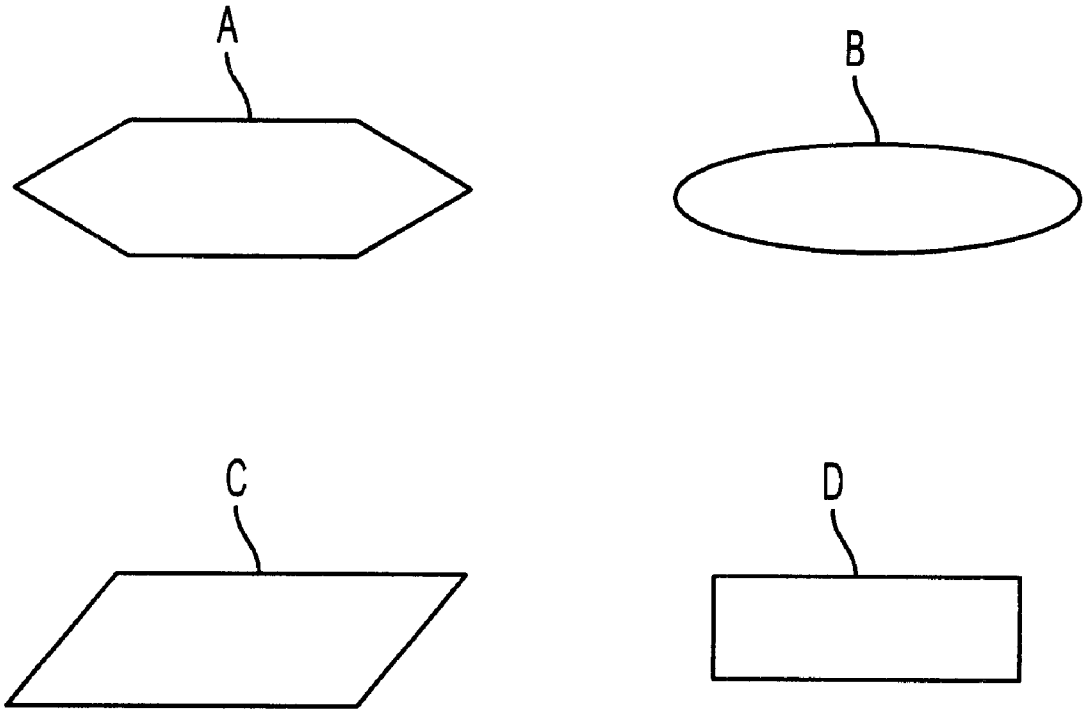
FIG. 6 is diagram illustrating various printed bias shapes.
Figure 7:
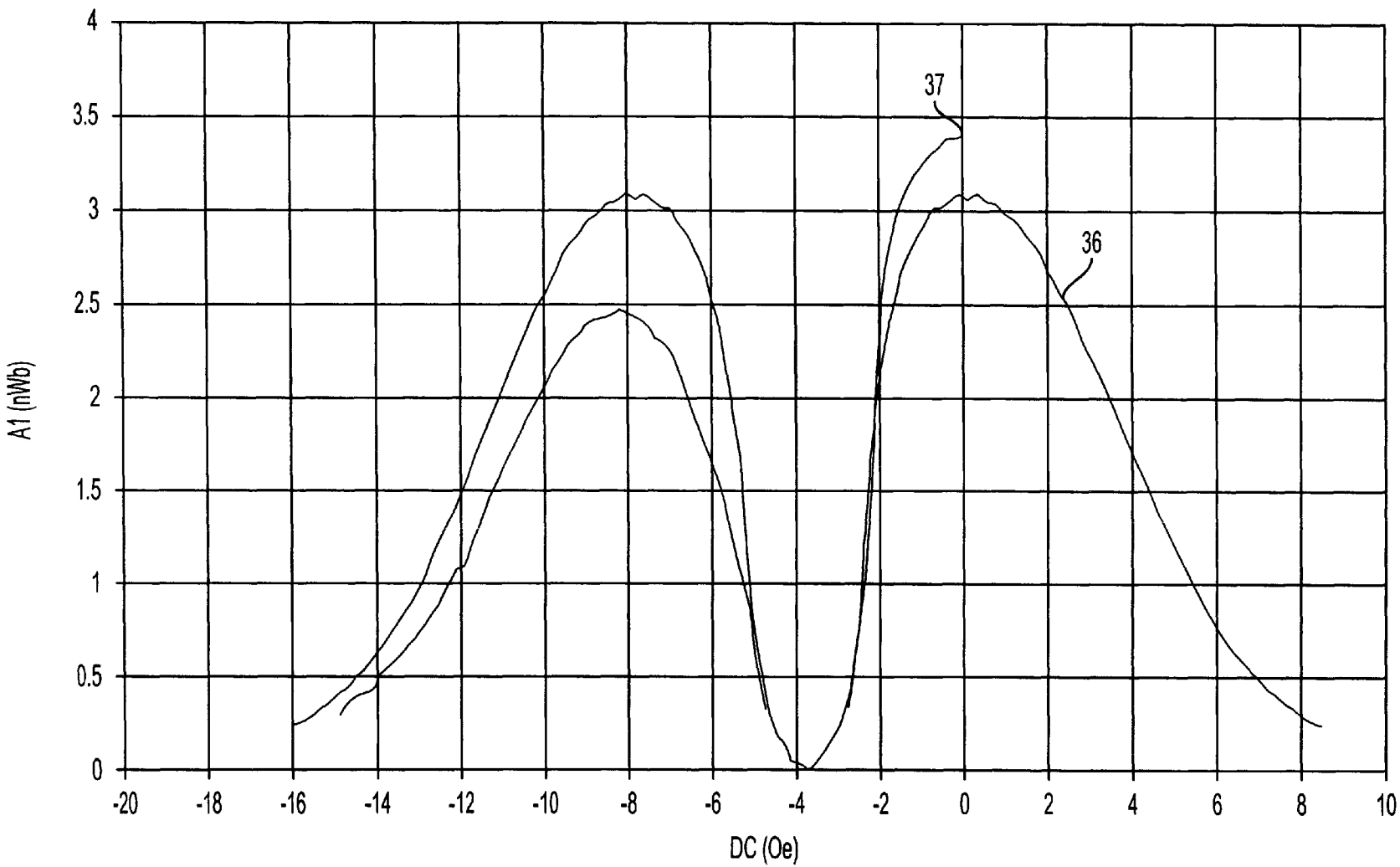
FIGS. 7 through 9 are plots of the response of EAS markers having printed biases with some of the shapes shown in FIG. 6.
Figure 8:
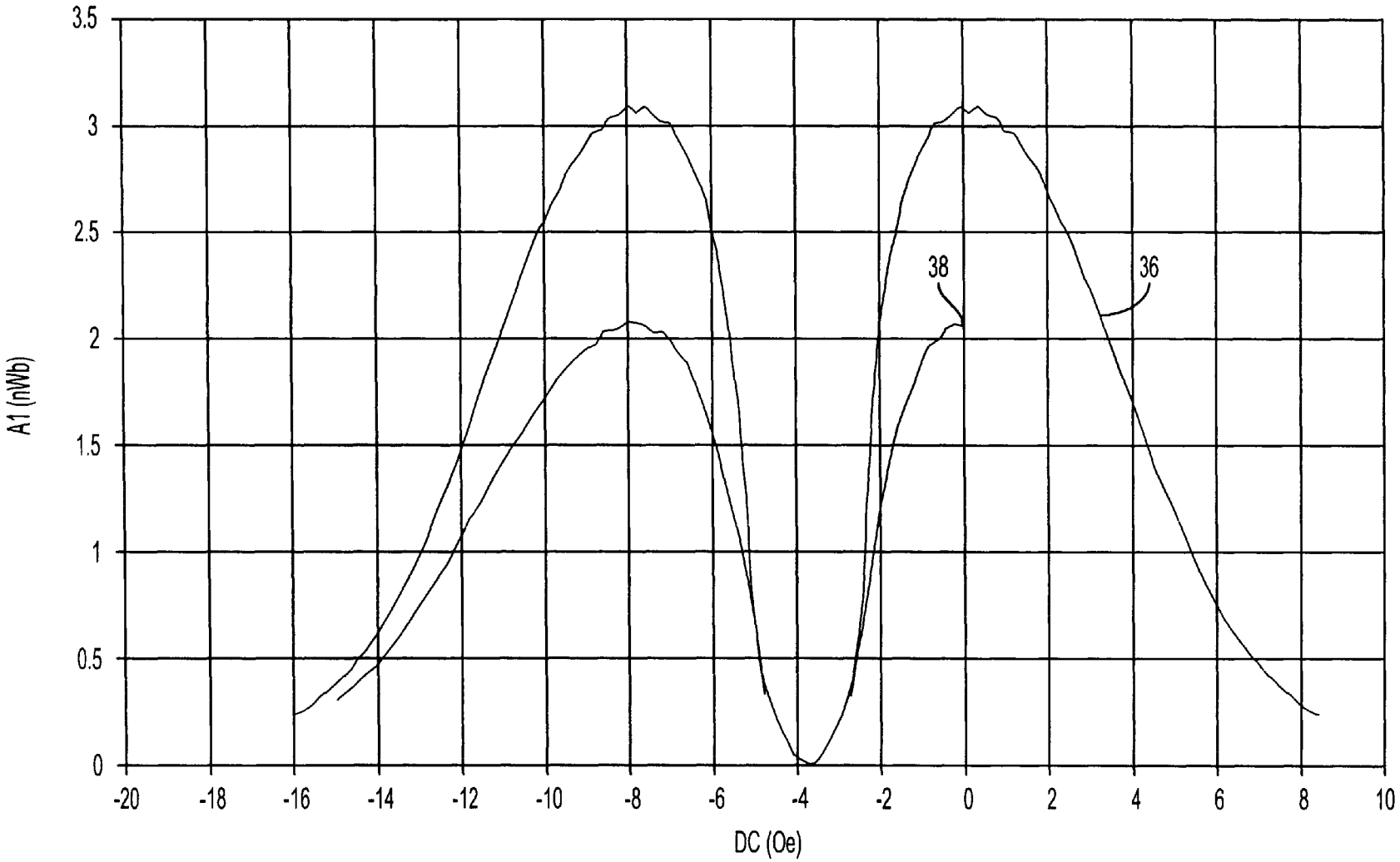
Figure 9:
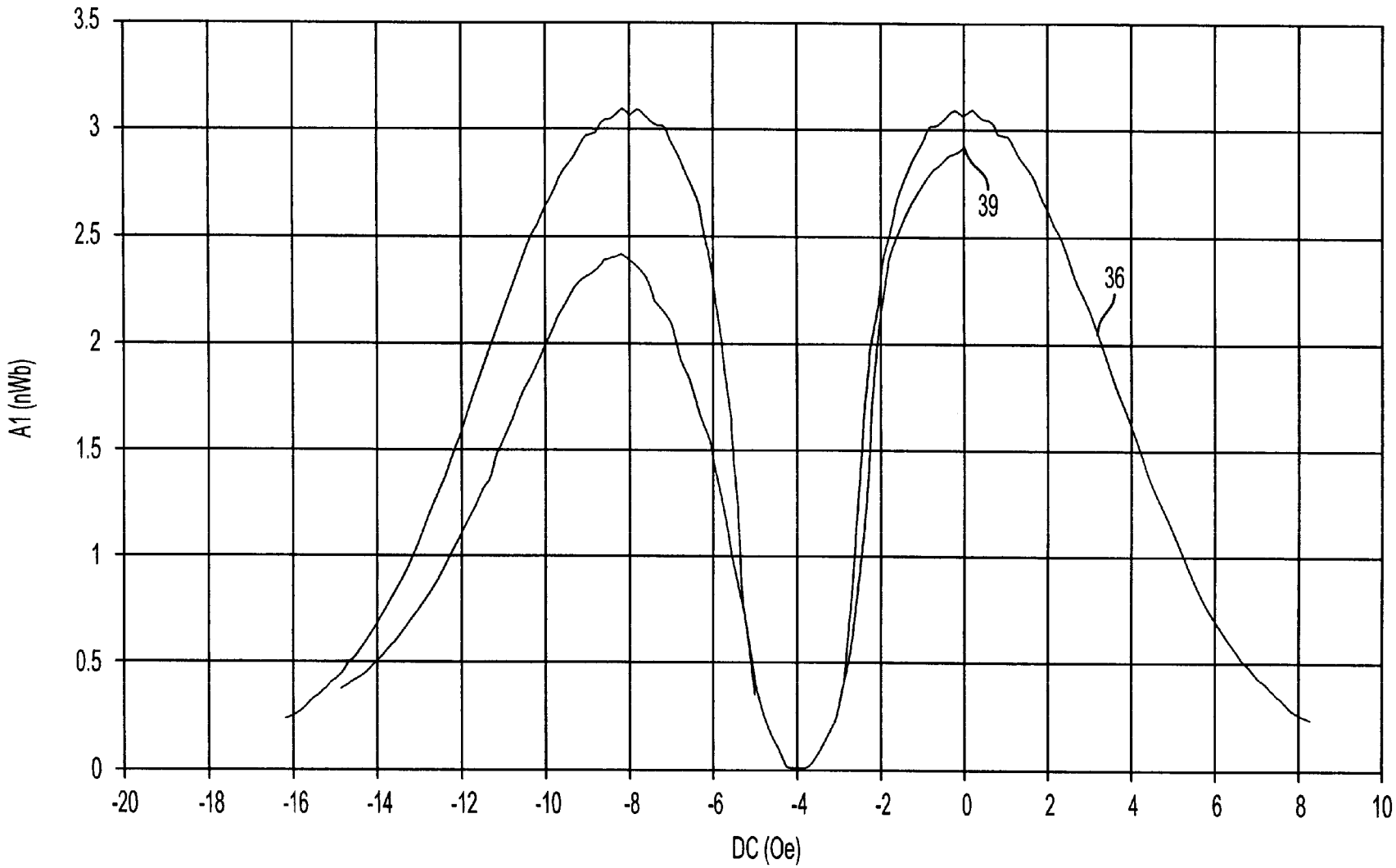

Referring to FIG. 6, the printed bias shapes tested are illustrated as shapes or patterns A–D. FIGS. 7, 8, and 9 illustrate the results of testing conducted on bias shape A, C, and D, respectively. Bias shape B will perform similarly to bias shape A, and is not separately tested. Referring to FIGS. 7–9, the amplitude response (A1), when in a DC magnetic field, of a resonator similar to the low bias resonator shown in FIG. 3 is illustrated at 36. The response of the resonator 36 is then compared to the response of an EAS marker made with each printed bias magnet shape tested. The peak responses of the EAS markers made with the printed bias shapes A, C, and D, occur at 37, 38, and 39, respectively. The difference between the ideal response 36 and each marker peak responses (37, 38, and 39) is about (+) 0.7 nWb for bias shape A, (–) 1.0 nWb for bias shape C, and (–) 0.2 nWb for bias shape D. By comparison, conventional EAS markers are typically about (–) 1.0 nWb. Referring to FIG. 10, 20 sample EAS markers made with a printed bias of shape A, and with a nominal resonance frequency of 58 kHz, were tested. The markers show excellent signal amplitude with an average amplitude of 3.1565 nWb and indicating little degradation due to magnetic clamping. This amplitude is equal to or even slightly higher than EAS markers using conventional bias magnets. Thus, EAS markers made with a printed bias as described herein respond with sufficient amplitude to be detected by a conventional magnetomechanical EAS system.

Figure 1:
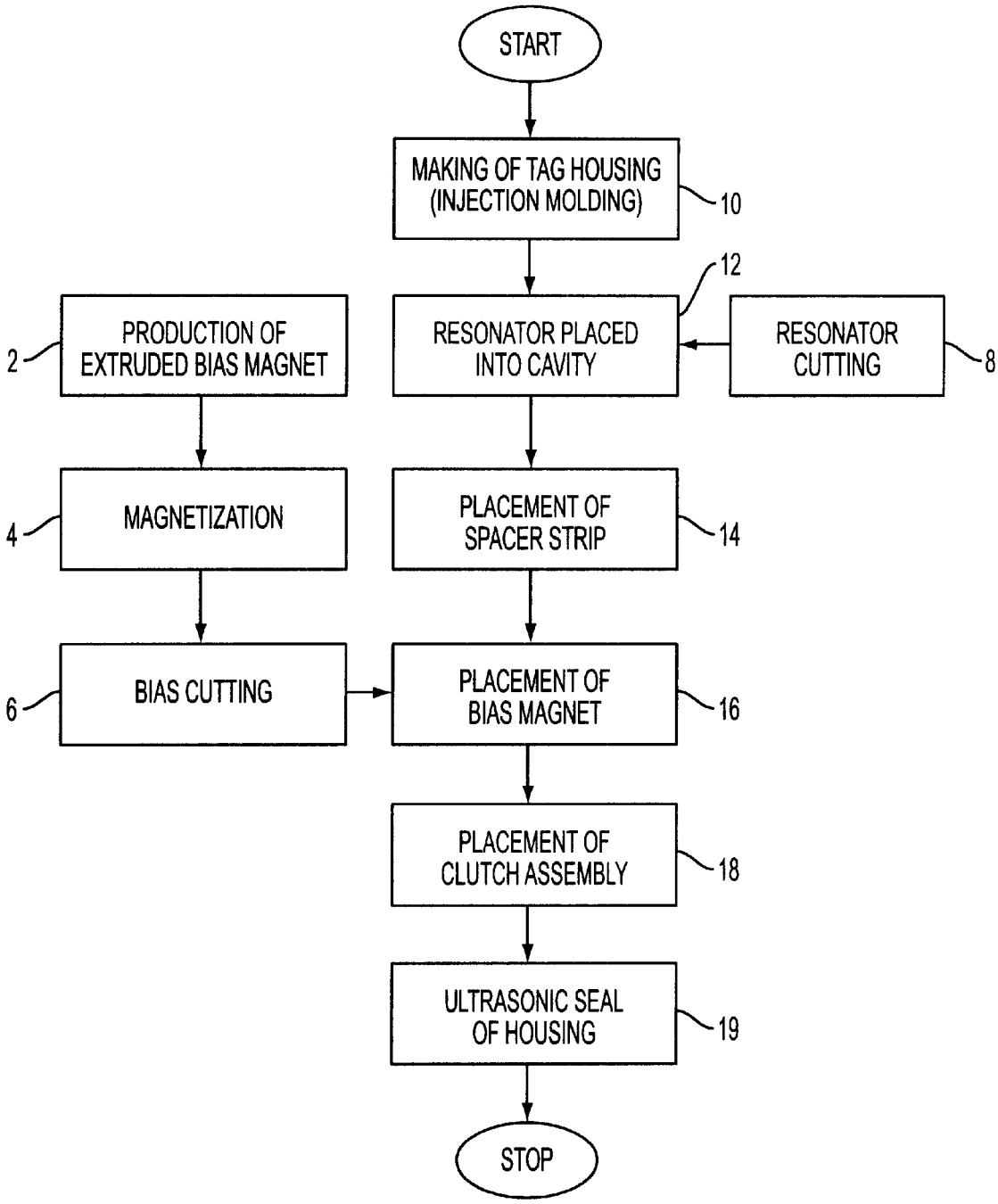
FIG. 1 (PRIOR ART)
FIG. 1 is a flow chart of the assembly process of a prior art nondeactivatable EAS hard tag.
Figure 2:
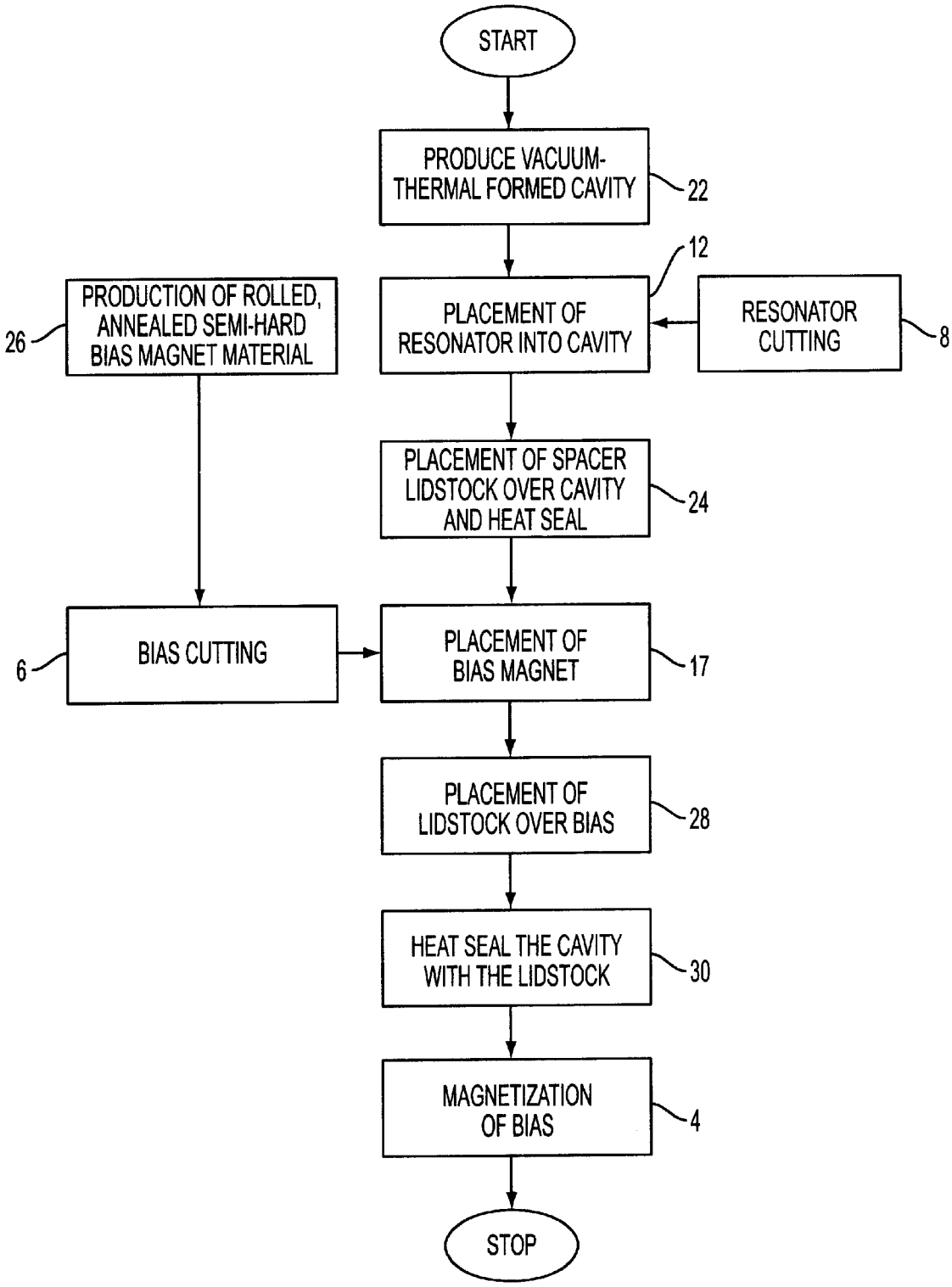
FIG. 2 (PRIOR ART)
FIG. 2 is a flow chart of the assembly process of a prior art deactivatable EAS label.
Figure 11:
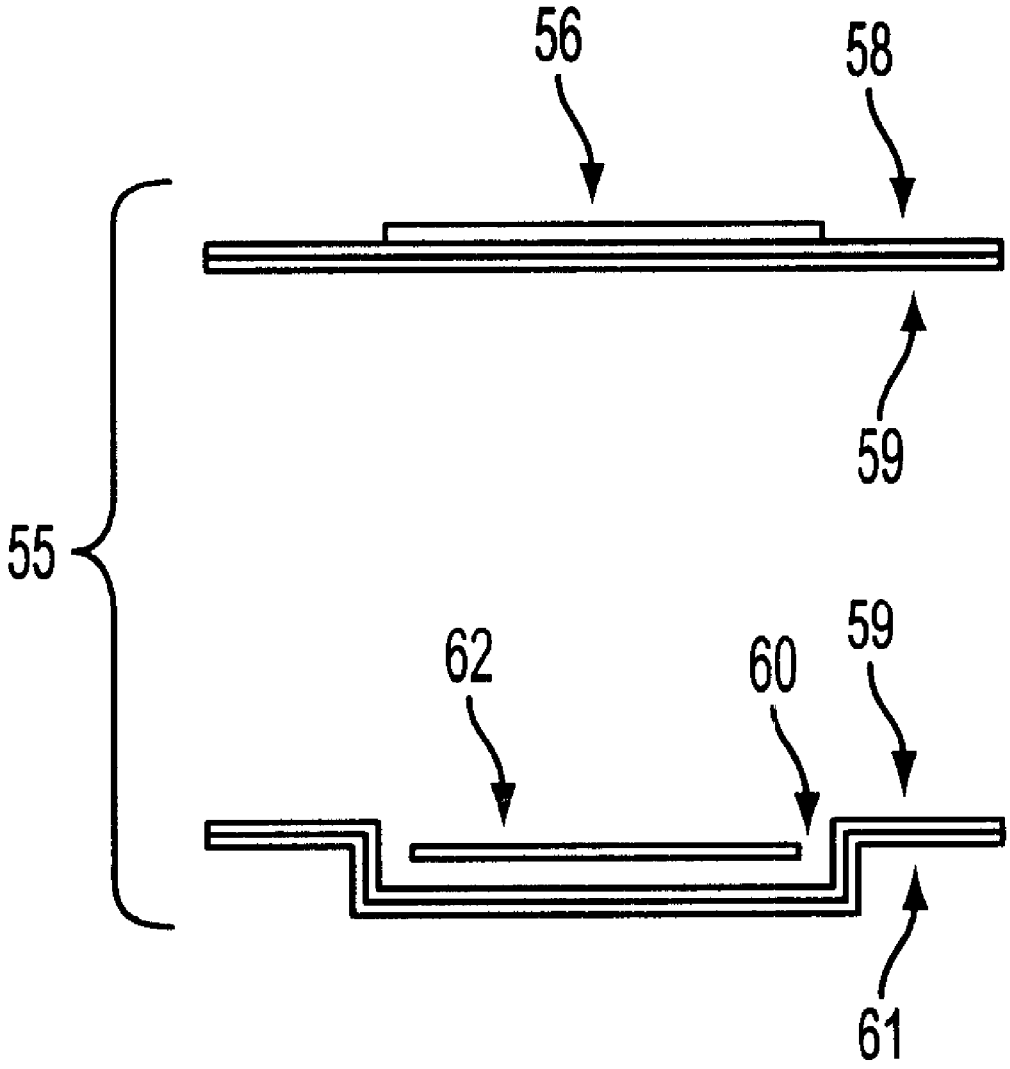
FIG. 11 is a partially exploded side elevation view of one embodiment of an EAS marker made according to the present invention.
Figure 12:
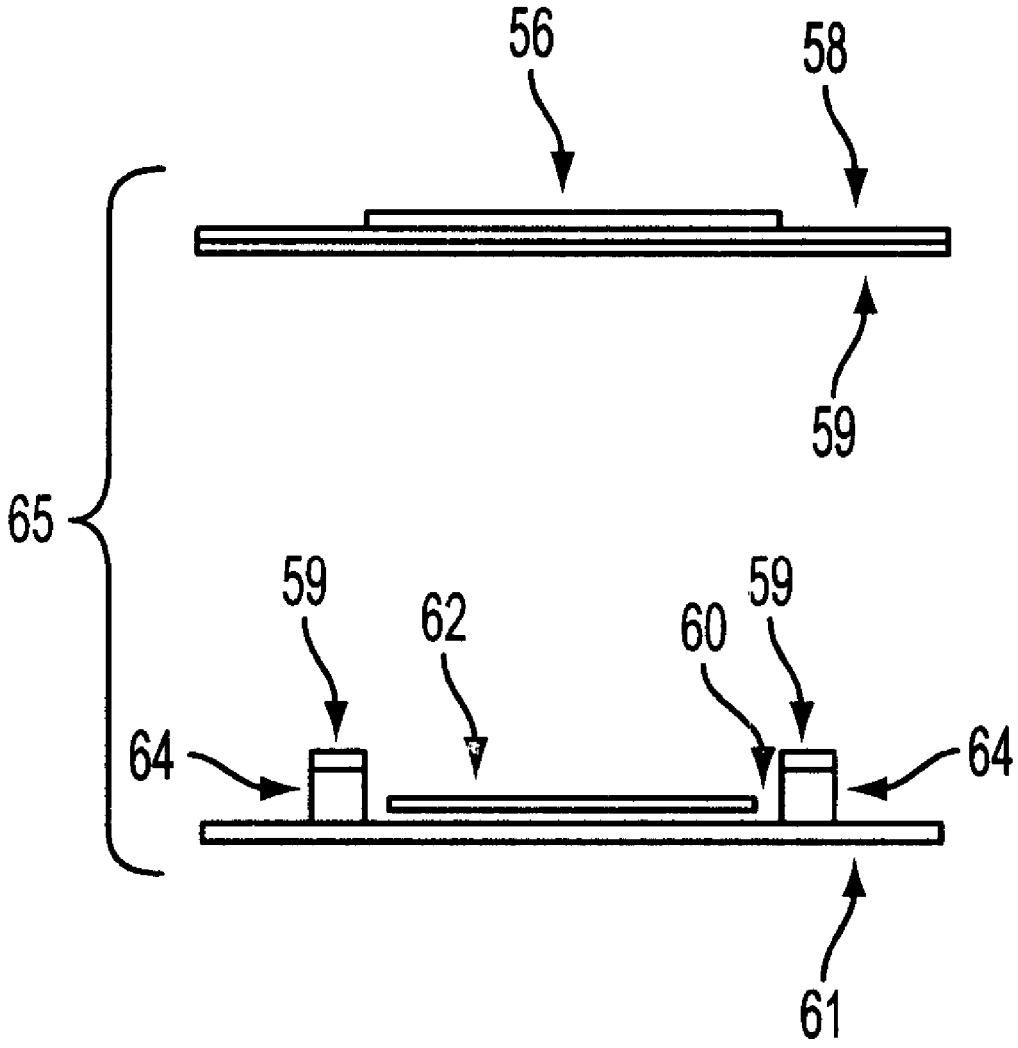
FIG. 12 is a partially exploded side elevation view of an alternate embodiment of an EAS marker made according to the present invention.
Figure 13:
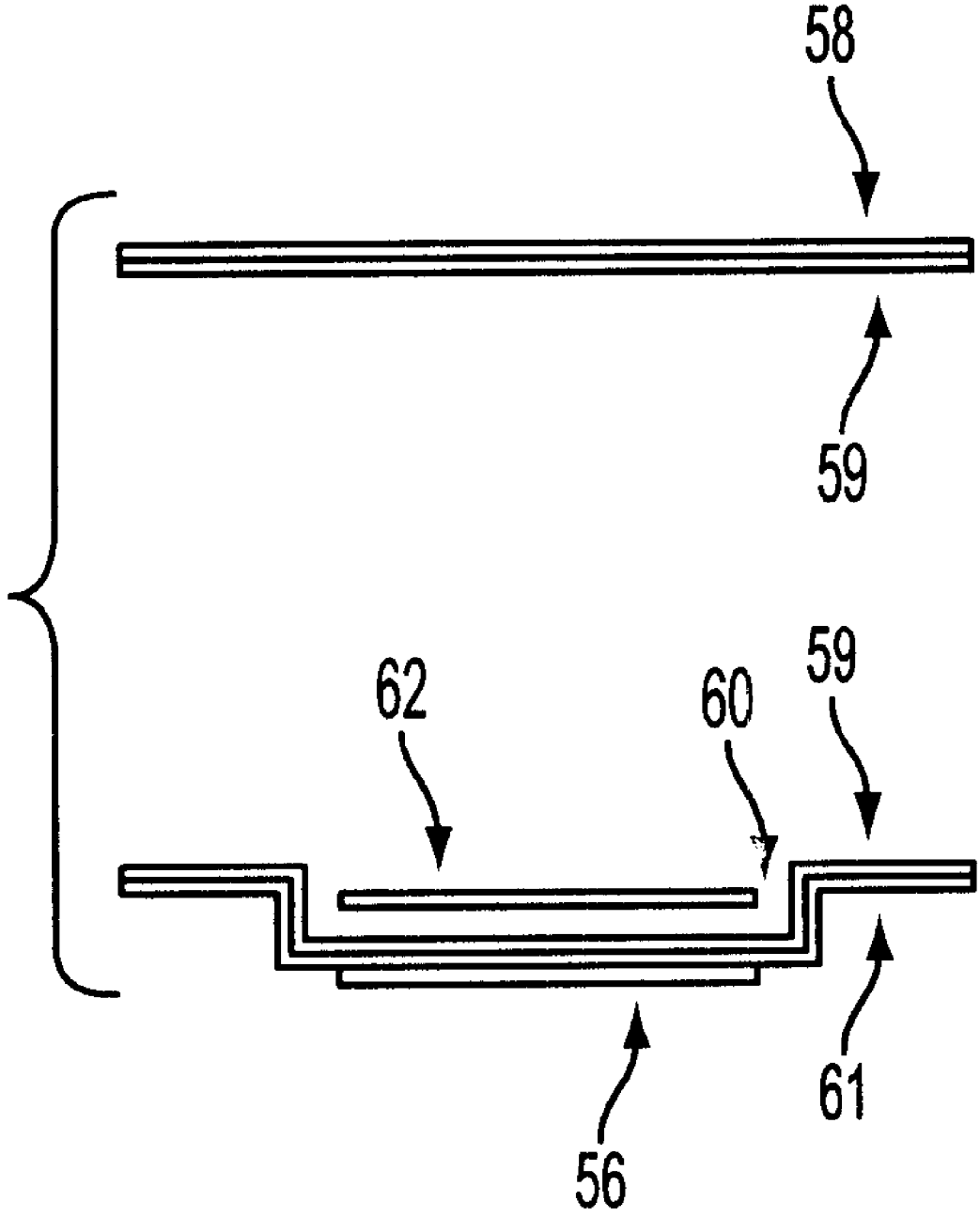
FIG. 13 is a partially exploded side elevation view of an alternate embodiment of an EAS marker made according to the present invention.

Referring to FIGS. 11, 12, and 13, one method of making an EAS marker with a printed bias includes printing a layer(s) of magnetic ink onto elements of the housing adjacent the resonator element(s). "Adjacent" the resonator is defined as any position that permits the magnetic field from the printed bias to enable the resonator to vibrate at the preselected frequency of resonance for the EAS marker when in an exciting electromagnetic field. With the printing process, the thickness of the magnetic layer is tightly controlled and relatively thinner thin that from the molding or extrusion process. In addition, a thick spacer element between the resonator and the bias is not needed, greatly reducing the thickness of the marker. The printing process can be implemented to produce a nondeactivatable EAS hard tag, illustrated in FIG. 1, in a manner similar to the present EAS label production process as illustrated in FIG. 2. Making EAS tags in this manner has the advantage of high-speed, automatic mass production process, that is not possible with the hard tag process shown in FIG. 1, In the manufacturing process, magnetic paint, or ink, is prepared by mixing magnetic particles with resin and solvent, which is printed and cured, by heat, UV, or the like, onto the label during or after assembly thereof. In a web-based, mass-production process similar to that shown in FIG. 2, resonant cavities are made out of a polymer thin sheet using a typical process such as vacuum thermal forming in which the thin polymer sheet is heated until softened, and then arrays of cavities are formed with a mold using vacuum forming. The resonator pieces ate cut from a reel of resonator material, and one or more pieces are placed into the cavities formed in the polymer sheet. In one embodiment, a laminated polymer sheet carrying the printed bias is precisely placed over the cavity. The laminated polymer sheet is then heat sealed, sealing the resonator(s) into the cavity. Both batch or linear processes are applicable using the polymer substrate with a printed bias. Using a printable bias, EAS markers can be produced efficiently using web-based mass production techniques.

Referring to FIG. 11, an EAS marker 55, made according to the inventive process is illustrated. The printed bias material 56 is printed onto the polymer sheet 58, which can be made of polyester (PET) or another material that exhibits similar temperature stability, and which includes a heat seal material 59. The cavity 60 is formed into the polystyrene or other housing material 61, which can include heat seal material 59. One or more resonators 62 are placed into the cavity 60, and the laminated polymer sheet 58 is precisely placed so that the bias 56 is over the cavity 60 and resonator 62, and heat sealed together.

Referring to FIG. 12, an alternate EAS marker 65, made according to the present invention is illustrated. The primary difference between EAS marker 55 and EAS marker 65 is the cavity that holds resonator 62 in EAS marker 65 is formed by printing cavity structures 64 using a nonmagnetic ink, instead of vacuum forming as in EAS marker 55. Heat seal material 59 can be printed onto structures 64, and heat sealed to polymer sheet 58 via heat seal material 59 also disposed on sheet 58, thus sealing resonator(s) 62 in cavity 60. U.S. patent application Ser. No. 09/821,398, filed on Mar. 29, 2001 and assigned to Sensormatic Electronics Corporation, the assignee hereof, discloses a method of forming a cavity by printing. The disclosure of application Ser. No. 09/821,398 is incorporated herein by reference.

Alternately, methods of sealing other than heat sealing can be employed such as but not limited to adhesives or RF-molding, which may eliminate heat sealing material 59. In addition, as illustrated in FIG. 13, the magnetic ink can be printed onto the housing material 61 of markers 55 and 65, either before or after formation of the cavity 60 and either before or after resonator strips 62 are placed and sealed into the cavity 60.

Figure 14A:
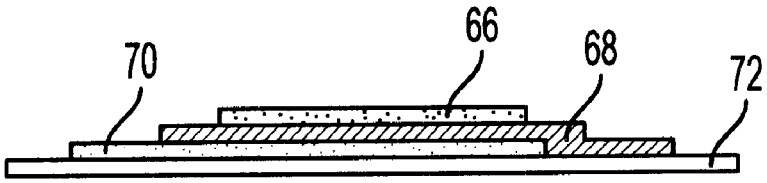
FIG. 14A is a side elevation view of an alternate embodiment of a printed bias made accordance with the present invention.
Figure 14B:
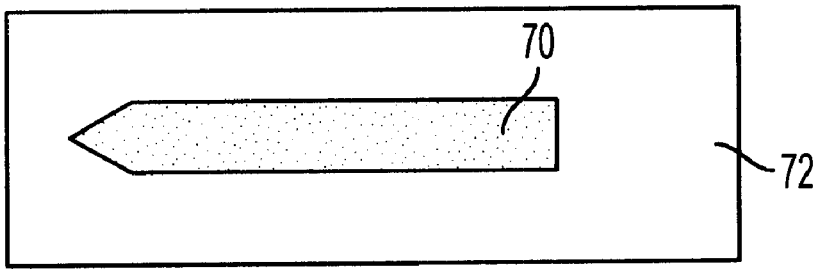
FIGS. 14B–14D are top plan views of various layers of that shown in FIG. 14A.
Figure 14C:
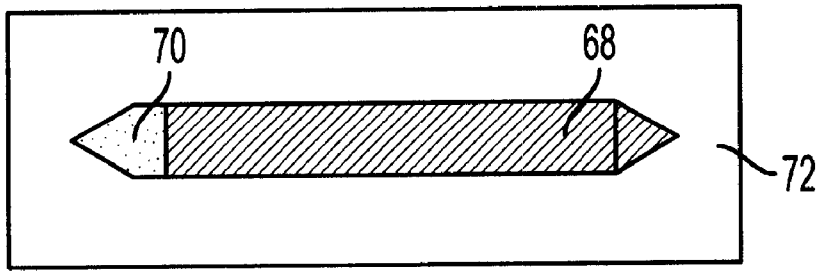
Figure 14D:
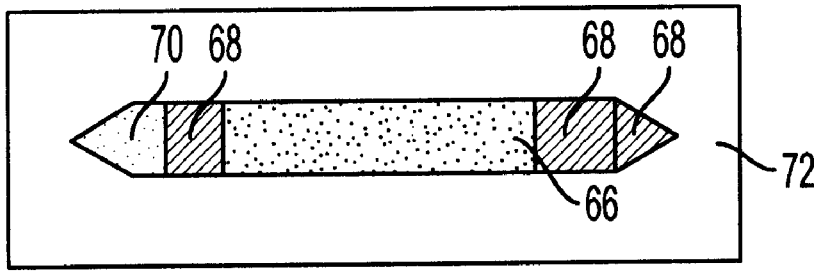

Referring to FIGS. 14A–14D, an alternate embodiment for the printed bias is illustrated. The performance of magnetomechanical EAS markers depends on the mechanical freedom of the resonator(s). Any presence of mechanical interference will have decreasing effects on marker efficiency. The magnetic bias pattern provides the proper magnetic condition for the resonator to freely vibrate. There is magnetic attraction between the resonator and bias, which creates friction. As a result, marker efficiency decreases. The bias can be printed to create a thickness profile along the length of the bias strip. A varying bias profile can help provide the resonator with sufficient magnetic field to vibrate properly and yet minimize the magnetic attractive force. The thickness profile of the bias can be achieved by multiple-pass printing. FIGS. 14A–14D illustrate three layer printing, but three is not to be limiting as any number of layers can be printed. FIG. 14A illustrates a side elevation view of the three bias layers 66, 68, and 70, printed on a substrate 72, which can be substrate 58 as described hereinabove and shown in FIGS. 11 and 12, or substrate 61 shown in FIG. 13. Bias layer 70 is printed first, followed by bias layers 68 and 66, respectively in successive printing passes. It should be understood that with more printing passes and thinner printing thickness, a smoother magnetic charge distribution profile can be achieved.

Figure 15:
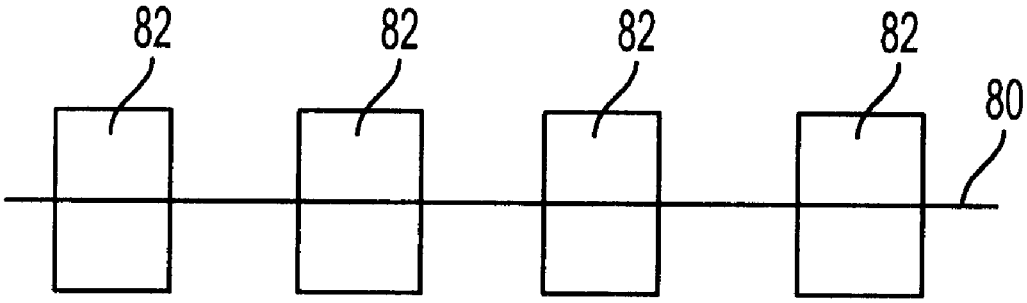
FIGS. 15 and 16 are diagrams illustrating an alternate embodiment of the present invention for a deactivatable harmonic EAS marker.
Figure 16:
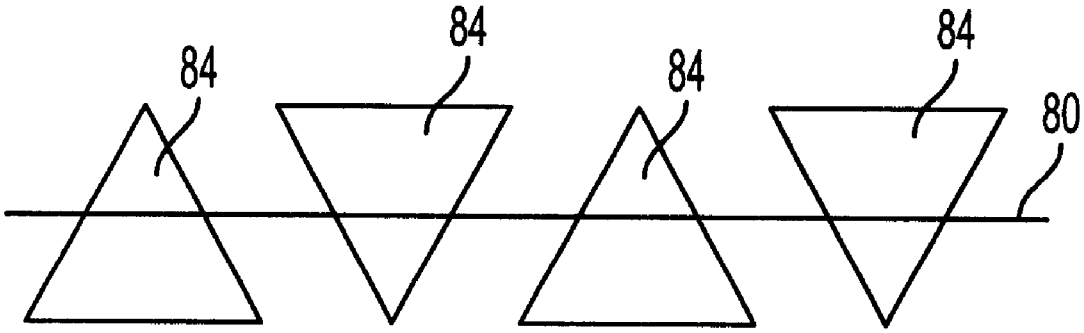

Referring to FIGS. 15 and 16, an alternate embodiment of the present invention can be used to deactivate a harmonic type of EAS marker. U.S. Pat. Nos. 5,341,125 and 6,121,879 disclose an EAS marker that is detected by relying on the extremely high permeability in the marker's magnetic material (80 in FIGS. 15 and 16). In the transmitted magnetic field of the interrogation zone, the material reaches its saturation state, changing the permeability from tens of thousands to near unity. This non-linear behavior creates rich amounts of harmonic signals that the EAS systems can detect. In addition to the magnetically soft material 80, an array of bias segments (82 and 84) can be used in a deactivatable harmonic marker. When the EAS marker is active, the bias segments 82 and 84 are demagnetized. To deactivate the marker, the bias segments 82 and 84 are magnetized. The stray magnetic field created by the array's dipole pattern effectively decreases the permeability of the magnetic material 80 reducing the high-order harmonic generation. The '879 patent discloses that the deactivation effectiveness depends on the shape, size, quantity, and arrangement of the bias segments. Printing the bias segments can provide easily varied bias shape, size, quantity and arrangement. Handling of a plurality of small individual segments is not required, and no scrap is generated as from the bias cutting process. In addition, metallic bias segments can be magnetized locally during the rolling and cutting process due to the induced stress resulting in difficulty obtaining a fully demagnetized state. A bias made of a printed paste is cured on a substrate in a naturally demagnetized state. FIGS. 15 and 16 illustrate two examples of bias shape, but virtually any shape can be printed to produce a bias segment of virtually any shape. It should be understood that the specific number of bias segments can be any number, and not limited to the number shown in FIGS. 15 and 16. The bias segments can be printed onto a layer (not shown) that is positioned in the neighborhood of the active magnetic material 80, as shown in FIGS. 15 and 16.

The application of a printed bias is not limited to the examples herein of a magnetomechanical or harmonic marker, but can be extended to any type of EAS marker that requires a bias magnet.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A magnetornechanical electronic article surveillance marker having a housing with a cavity formed therein, a magnetostrictive resonator member disposed within the cavity, a cover connected to the housing over the cavity capturing the resonator member therein, and a bias magnet disposed adjacent the resonator member, said bias magnet comprising a magnetic powder mixed with at least one material to form a magnetic ink, said magnetic ink disposed adjacent the resonator by printing in a preselected shape onto the housing or onto the cover and further including a plurality of layers of said magnetic ink.

2. The electronic article surveillance marker of claim 1 wherein said bias magnet being printed in a preselected shape onto a substrate, said substrate being connected to the housing or to the cover wherein said bias magnet is disposed adjacent the resonator.

3. A method of making an magnetomechanical electronic article surveillance marker, comprising:

preparing magnetic ink by mixing magnetic particles with a resin and solvent material;

printing said magnetic ink in a preselected pattern onto a substrate;

curing said magnetic ink;

providing a housing having a cavity formed therein;

cutting and placing at least one resonator into said cavity;

placing said substrate over said cavity wherein said magnetic ink is aligned adjacent said resonator; and, connecting said substrate to said housing capturing said resonator within said cavity wherein said magnetic ink is disposed adjacent said resonator.

4. The method of claim 3 wherein said printing and said curing are performed in a plurality of passes to form multiple layers of magnetic ink on said substrate.

5. The method of claim 3 wherein said cavity is formed by printing a nonmagnetic ink onto a substantially planar housing member.

6. The method of claim 3 further comprising sealing a cover to said housing to capture said resonator within said cavity prior to connecting said substrate to said housing.

7. A method of making an magnetomechanical electronic article surveillance marker, comprising:

providing a housing having a cavity formed therein;

preparing magnetic ink by mixing magnetic particles with a resin and a solvent material;

printing said magnetic ink in a preselected pattern onto said housing adjacent said cavity;

curing said magnetic ink;

cutting and placing at least one resonator into said cavity;

placing a cover over said cavity; and, sealing said cover to said housing capturing said resonator within said cavity.

8. The method of claim 7 wherein said printing and said curing are performed in a plurality of passes to form multiple layers of magnetic ink on said substrate.

9. The method of claim 7 wherein said cavity is formed by printing a nonmagnetic ink onto a substantially planar housing member.

10. The method of claim 7 wherein said printing step comprises printing magnetic ink onto a substrate and connecting said substrate to said housing.

11. A method of making an magnetomechanical electronic article surveillance marker, comprising:

providing a housing having a cavity formed therein;

cutting and placing at least one resonator into said cavity;

placing a cover over said cavity;

sealing said cover to said housing capturing said resonator within said cavity;

preparing magnetic ink by mixing magnetic particles with a resin and a solvent material;

printing said magnetic ink in a preselected pattern onto said housing adjacent said cavity; and, curing said magnetic ink.

12. The method of claim 11 wherein said printing and said curing are performed in a plurality of passes to form multiple layers of magnetic ink on said substrate.

13. The method of claim 11 wherein said cavity is formed by printing a nonmagnetic ink onto a substantially planar housing member.

14. The method of claim 11 wherein said printing step comprises printing magnetic ink onto a substrate and connecting said substrate to said housing.

15. A method of making an magnetomechanical electronic article surveillance marker, comprising:

providing a housing substrate;

preparing magnetic ink by mixing magnetic particles with a resin and solvent material;

printing said magnetic ink in a preselected pattern onto said housing substrate;

curing said magnetic ink;

forming a cavity in said housing substrate wherein said magnetic ink is adjacent said cavity;

cutting and placing at least one resonator into said cavity;

placing a cover over said cavity; and, sealing said cover to said housing capturing said resonator within said cavity.

16. The method of claim 15 wherein said printing and said curing are performed in a plurality of passes to form multiple layers of magnetic ink on said substrate.

17. The method of claim 15 wherein said cavity is formed by printing a nonmagnetic ink onto a substantially planar housing member.

18. The method of claim 15 wherein said printing step comprises printing magnetic ink onto a bias substrate and connecting said bias substrate to said housing.

19. A harmonic electronic article surveillance marker having an active element for receiving and radiating an interrogation signal generated by an electronic article surveillance system transmitter, the active element being an elongated strip of magnetic material that produces harmonic perturbations of the interrogation signal, and a plurality of control elements disposed along the active element, the control elements for being magnetized to deactivate the electronic article surveillance marker, each of said plurality of control elements comprising a magnetic powder mixed with at least one material to form a magnetic ink, said magnetic ink disposed along the active element by printing in at least one preselected pattern.

* * * * *

UNITED STATES PATENT AND TRADEMARK OFFICE

CERTIFICATE OF CORRECTION

PATENT NO. : 6,538,572 B1
DATED : March 25, 2003
INVENTOR(S) : Lian et al.

It is certified that error appears in the above-identified patent and that said Letters Patent is hereby corrected as shown below:

Column 2,
Line 60, replace “mapetomechanical” with -- magnetomechanical --

Column 4,
Line 5, insert -- in -- before “accordance”

Column 5,
Line 53, replace “thin” with -- than --

Column 6,
Line 5, replace “ate” with -- are --

Signed and Sealed this

First Day of July, 2003

JAMES E. ROGAN
*Director of the United States Patent and Trademark Office*